United States Patent [19]

Lee

[11] Patent Number: 4,877,288

[45] Date of Patent: Oct. 31, 1989

[54] LOUNGE CHAIR COVER

[76] Inventor: Susan Lee, 1344 Laurel Valley, Pontiac, Mich. 48054

[21] Appl. No.: 240,549

[22] Filed: Sep. 6, 1988

[51] Int. Cl.[4] ..... A47C 31/11

[52] U.S. Cl. ..... 297/229; 297/191; 297/220

[58] Field of Search ..... 297/219, 188, 220, 229, 297/191

[56] References Cited

U.S. PATENT DOCUMENTS

| | | | |
|---|---|---|---|
| 3,014,259 | 12/1961 | Bing | 297/191 |
| 3,151,909 | 10/1964 | Gerdetz | 297/188 |
| 4,213,649 | 7/1980 | Sell . | |
| 4,273,380 | 6/1981 | Silvestri | 297/229 |
| 4,302,046 | 11/1981 | Lazazzero | 297/229 X |
| 4,536,028 | 8/1985 | Jones et al. | 297/229 X |
| 4,553,785 | 11/1985 | Duke, Jr. et al. | 297/229 |
| 4,725,094 | 2/1988 | Greer | 297/191 X |

FOREIGN PATENT DOCUMENTS

| | | | |
|---|---|---|---|
| 486612 | 7/1976 | Australia | 297/229 |

*Primary Examiner*—Peter R. Brown

*Attorney, Agent, or Firm*—Gifford, Groh, Sheridan, Sprinkle and Dolgorukov

[57] ABSTRACT

A lounge chair cover includes an elongated panel of fabric having lateral edges and end borders. Back or end flaps are secured to the panel at the end borders and partially along the lateral edges to define inwardly directed pockets at the ends of the panel. The pockets are dimensioned to be inserted over the ends of a standard multiposition lounge chair so that the panel covers the entire top surface area of the chair while the back or end flaps cover only the outermost portions of the underside of the chair, elastic bands being used to snug the flaps against the chair. Additional pockets are formed in the back flap for convenient storage of miscellaneous articles. A cover flap depends from the back flap border and contains a hidden pocket for the storage of valuables out of sight. A pillow pocket is formed in the panel near one end for the slidable insertion of an inflatable pillow.

11 Claims, 1 Drawing Sheet

LOUNGE CHAIR COVER

BACKGROUND OF THE INVENTION

I. Field of the Invention

This invention relates to chair covers and, in particular, to a cover for a multiple position lawn chair, the cover being secured to the chair and having pockets formed in the chair cover.

II. Description of the Prior Art

Lounge chairs have traditionally been used at the beach or in the backyard to provide a semi-reclining chair. More recently, multiple position chairs have appeared which have substantially identical back support portions and leg support portions both of which hinge from a central or seat portion and are lockable into a variety of positions. A primary drawback of these chairs, particularly in hot and humid weather, is the discomfort caused by the plastic or nylon webbing extending across the tubular frame. Consequently, numerous chair covers have been devised, running the gamut from a simple towel drapes over the chair to elaborate pocketed slip covers.

In one previously known chair cover an elongated fabric panel is doubled back upon itself at both ends and the lateral edges are secured together to form pockets with inwardly directed openings. Such a chair cover is disclosed in U.S. Pat. No. 4,553,785 to Duke et al. In the Duke patent, however, the pockets formed are unnecessarily deep, covering the entire lower surface area of the back and leg support portions of the chair. This adds additional bulk and weight to the chair cover and makes it somewhat more difficult to install on a chair. Moreover, items located in the skirt pockets hanging from the chair cover are particularly subject to dew, surf, dirt and wind, due to their location.

SUMMARY OF THE PRESENT INVENTION

These and other disadvantages are overcome by the present invention which comprises an improved cover for a lounge chair. The cover comprises an elongated panel of fabric having a length substantially equal to that of the extended lounge chair and a width substantially equal to the width of the lounge chair. End or back flaps are secured to the head end and foot end of the fabric panel to form a pair of inwardly directed pockets. The end flaps are approximately as wide as the panel but each has a length substantially less than the length of the back support or leg support portions of the chair. The pockets are spaced apart and dimensioned so that the back support and leg support of the chair can be inserted through an open edge of each pocket and into the bottom of the pocket to secure the cover to the chair.

Preferably, elastic is sewn into the end flap along u the open edge of the pocket so that the end flaps are drawn tightly against the lower or back surface of the chair. It is also preferable that a number of additional pockets are formed in the chair cover for various purposes. For example, a pillow pocket can be formed in the head end of the panel to receive an inflatable pillow; additional pockets can be formed in the end or back flaps for holding miscellaneous articles such as books or lotions; and a secret or hidden pocket can be formed on the interior side of the end flap or on the interior side of a covering flap.

BRIEF DESCRIPTION OF THE DRAWING

The present invention will be more fully understood by reference to the following detailed description when read in conjunction with the accompanying drawing in which like reference characters refer to like parts throughout the several views

DETAILED DESCRIPTION OF THE PREFERRED EMBODIMENT

Figure 1:
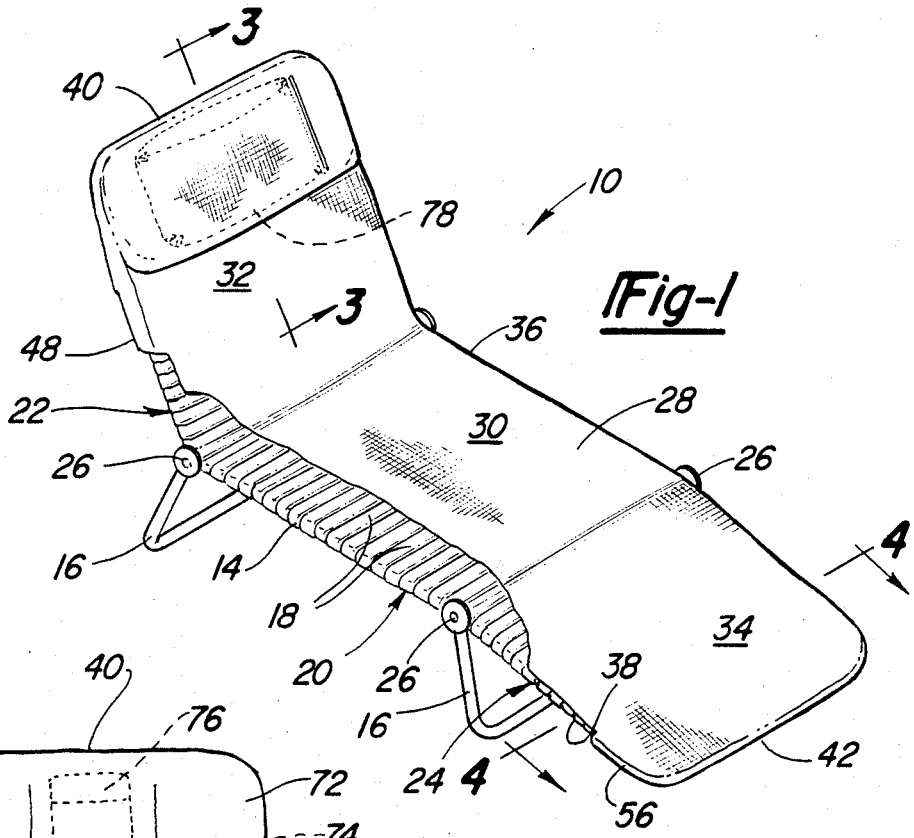
FIG. 1 is a cut away top perspective view of a preferred embodiment of the chair cover according to the present invention.

Referring first to FIG. 1, the cover 10 of the present invention is thereshown arranged on a conventional multiposition lounge chair 12. The chair 12 includes a tubular metal frame 14 supported by a pair of leg frames 16. Webbing 18, of a flat or tubular type, extends across the frame 14 in the well known manner. The chair 12 includes a seat portion 20 hingedly secured to a back support 22 and a leg support 24 by means of hinges 26 in the tubular frame 14.

Figure 3:
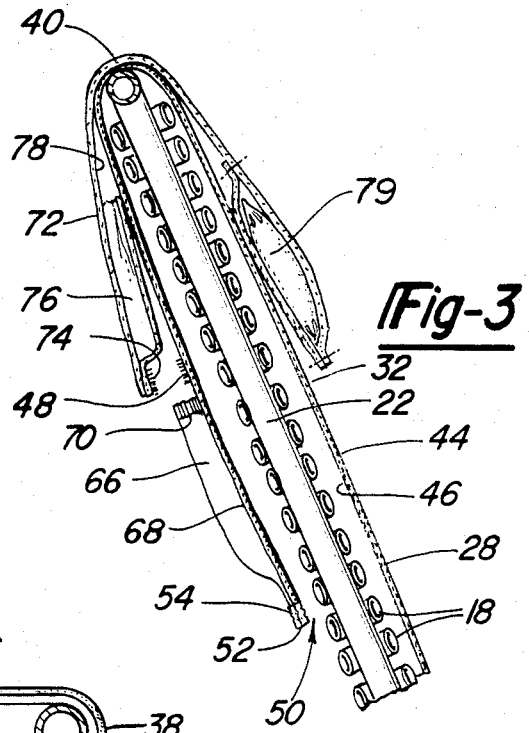
FIG. 3 a cross sectional view taken substantially along line 3—3 of FIG. 1.
Figure 4:
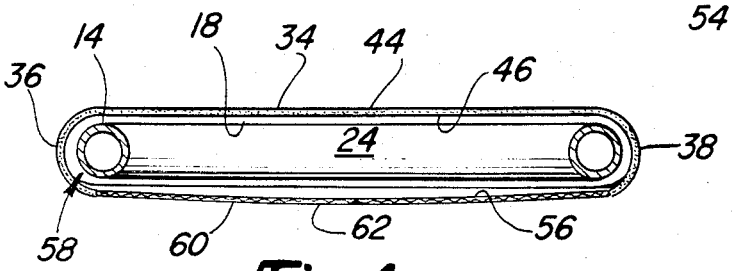
FIG. 4 a cross sectional view taken substantially along line 4—4 of FIG. 1.

The cover 10 includes an elongated panel 28 which has an intermediate section 30 corresponding to the seat portion 20, a head end 32 corresponding to the back support 22 and a foot end 34 corresponding to the leg support 24. The panel 28 further includes lateral borders 36, 38, a head end border 40 and a foot end border 42. As best seen in FIGS. 3 and 4, the panel 28 includes an outer face 44 and an inner face 46. Preferably, the panel 28 is made of a durable, heavy weight fabric that is comfortable and absorbant. Terry cloth is an ideal fabric for the cover.

Figure 2:
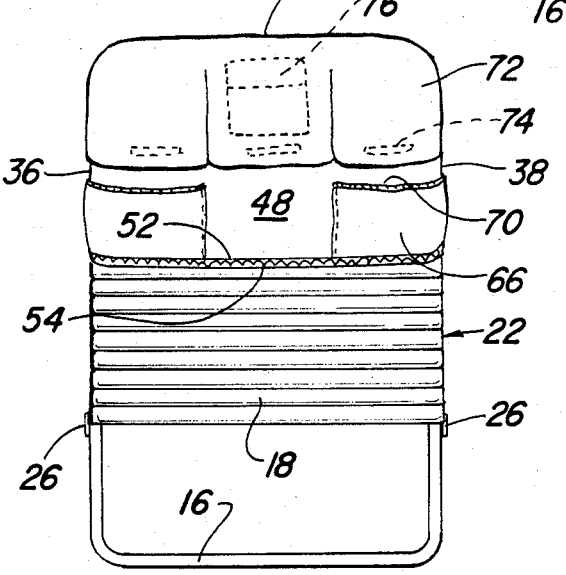
FIG. 2 is rear perspective view.

With reference now to FIGS. 2 and 3, a back or end flap 48 is attached to the head end 32 along the head end border 40 and the lateral edges 36 and 38. The back flap 48 defines a pocket 50 into which the back support 22 can be inserted. The remaining side of the back flap 48 defines an open edge 52 which is inwardly directed towards the intermediate section 30. Preferably, an elastic band 54 is sewn to the back flap 48 along the open edge 52 in order to draw the back flap 48 into close proximity with the back surface of the back support 22.

Referring now to FIGS. 1 and 4, the foot end 34 of the panel 28 is similarly secured to a back or end flap 56 along the foot end border 42 and the lateral edges 36 and 38. Thus, the end flap 56 forms a pocket 58 to receive the leg support 24 of the chair 12. The remaining side of the end flap 56 defines an open edge 60 directed inwardly toward the intermediate section 30. Preferably, an elastic band 62 is sewn to the end flap 56 along its open edge 60 to draw the end flap 56 into close proximity with the leg support 24.

The back or end flaps 48 and 56 are dimensioned to snugly engage the respective back support 22 or leg support 24, but do not extend all the way from the end borders 40 and 42 to the hinges 26. Instead, the back or end flaps 48 and 56 are short enough so that they do not cover the entire lower surface of the back support 22 and the leg support 24, respectively. Ideally, the open edges 52 and 60 which define the pockets 50 and 58 formed by the back or end flaps 48 and 56 are located about one third to one half of the distance from the respective end border 40 or 42 to the hinges 26. The back or end flaps 48 and 56 may be separate pieces sewn or otherwise fastened to the end portions 32 and 34. Alternatively, the panel 28 may include extensions which are doubled over to form the back or end flaps 48 and 56.

Referring now particularly to FIGS. 2 and 3, the back flap 48 includes a number of additional pockets 66 which are sewn into or otherwise formed in the outer face 68 of the back flap 48. The additional pockets 66 have open edges 70 directed oppositely from the open edge 52 of the pocket 50; i.e. the open edges 70 are directed toward the head end border 40. This orientation is required so that miscellaneous items such as reading material, lotions, glasses and personal radios can be stored in the additional pockets 66 when the back support 22 is in any upright position above horizontal. Furthermore, the open edges 70 may include elastic, snaps or other fastening means to keep the additional pockets 66 from gaping open.

Still referring to FIGS. 2 and 3, a cover flap 72 may additionally be secured to the back flap 48 along the head end border 40 where the back flap 48 is secured to the head end 32 of the panel 28. The cover flap 72 hangs down over the back support 22 and can provide a cover for the additional pockets 66. Fastening means 74 such as Velcro TM brand adhesive strips, snaps, buttons or the like may be used to secure a cover flap 72 to the back flap 48. In addition, a hidden pocket 76 may be formed on the interior face 78 of the cover flap 72. The hidden pocket 76 is ideal for storage of watches, rings, money or other valuables which are best stored out of sight.

Referring now to FIGS. 1 and 3, a pillow pocket 79 is formed in the head end 32 of the panel 28. The pillow pocket 79 may be formed on the outer face 44 or the inner face 46 of the panel 28 but, preferably, it is formed in the inner face 46. The pillow pocket 79 can have an open side directed towards a lateral border 36 or 38 but, preferably, the open side is directed towards the head end border 40. The pillow pocket 79 is adapted to slidably receive an inflatable pillow for user comfort.

Use of the cover 10 requires little additional description. With the back support 22 and the leg support 24 of the chair 12 both in a somewhat elevated position, the panel 28 is placed over the ends of the chair 12 so that the back support 22 is inserted into the pocket 50 and the leg support 24 is inserted into the pocket 58. The chair 12 can then be readjusted to a final resting position, whereupon the head end 32 covers substantially the entire area of the back support 22, the intermediate section covers substantially the entire area of the seat portion 20 and the foot end 34 covers substantially the entire area of the leg support 24. Items can easily be inserted into or removed from the additional pockets 66 by an occupant of the chair 12 simply by reaching around the lateral edges 36 or 38 to the back or under surface of the back support 22. The elastic bands 54 and 62 hold the cover 10 snugly onto the chair 12.

The foregoing detailed description of the preferred embodiment has been given for clearness of understanding only and no unnecessary limitations should be understood therefrom. Some modifications will be obvious to those skilled in the art to which the invention pertains, without deviation from the spirit of the invention as defined by the scope of the appended

I claim:

1. A lounge chair cover for covering a conventional multiple position lounge chair of the type having a central seat portion supported on legs, a back support hinged to the seat portion and a leg support hinged to an opposite side of the seat portion, the supports and the seat portion each having a top and a bottom surface of webbing or the like, said covering comprising:

an elongated panel of fabric having a head end, a foot end and an intermediate section dimensioned to cover substantially the entire top surface of the back support, the leg support and the seat portion, respectively;

a pair of end flaps, each dimensioned to cover less than the entire surface area of the lower surface of one of the back support and the leg support;

means for securing each of said end flaps to an outermost portion of a respective one of said head and leg end of said panel, forming a pocket in each of said head and foot ends, said pockets being spaced apart and each having an open edge directed inwardly so that the back support and the leg support of the chair can be inserted through said open edges and into a respective one of said pockets;

a cover flap extending from said end flap; and means defining a secret pocket disposed on an underside of said cover flap and having an opening directed towards said head end.

2. The cover as defined in claim 1, further comprising elastic bands secured to each of said end flaps along said open edge of said pocket.

3. The cover as defined in claim 1 further comprising at least one additional pocket formed in one of said end flaps, said additional pocket having a open edge. directed oppositely from the open edge of the pocket formed by said end flap.

4. The cover as defined in claim 3 wherein said at least one additional pocket comprises a plurality of additional pockets disposed on an outside surface of the end flap secured to said head end of the panel.

5. The cover as defined in claim 3 and comprising a cover flap extending from the end flap where said end flap is secured to said head end of the panel, said cover flap being dimensioned to overlap and cover a portion of said end flap.

6. The cover as defined in claim 5 wherein said cover flap includes means for fastening said cover flap to said end flap.

7. The cover as defined in claim 6 wherein said fastening means comprises hook-and-loop fastening means.

8. The cover as defined in claim 1, further comprising means defining a pillow pocket in said head end of the panel, said pillow pocket having an opening directed away from said intermediate section.

9. The cover as defined in claim 1 wherein said fabric comprises a heavy weight terry cloth.

10. The cover as defined in claim 1 wherein said end flaps comprise extensions of said panel doubled back to partially overlap said head and foot ends.

11. A lounge chair cover for covering a conventional multiple position lounge chair of the type having a central seat portion supported on legs, a back support hinged to the seat portion and a leg support hinged to an opposite side of the seat portion, the supports and the seat portion each having a top and a bottom surface of webbing or the like, said cover comprising:

an elongated panel of fabric having a head end, a foot end and an intermediate section dimensioned to cover substantially the entire top surface of the back support, the leg support and the seat portion, respectively;

a pair of end flaps, each dimensioned to cover less than the entire surface area of the lower surface of one of the back support and the leg support;

means for securing each of said end flaps to an outermost portion of a respective one of said head and leg ends of said panel, forming a pocket in each of said head and foot ends, said pockets being spaced apart and each having an open edge directed inwardly so that the back support and the leg support of the chair can be inserted through said open edges and into a respective one of said pockets;

at least one additional pocket formed in one of said end flaps, said additional pocket having an open edge directed oppositely from the open edge of the pocket formed by said end flap;

a cover flap extending from the end flap where said end flap is secured to said head end of the panel, said cover flap being dimensioned to overlap and cover a portion of said end flap; and means defining a secret pocket disposed on an underside of said cover flap and having an opening directed towards said head end.

* * * * *